US010035366B2

(12) United States Patent
Quintero Ruiz et al.

(10) Patent No.: US 10,035,366 B2
(45) Date of Patent: Jul. 31, 2018

(54) DETERMINING AN ALIGNMENT CHARACTERISTIC BASED ON DISTANCES OF FEATURES OF A PRINTED PATTERN

(71) Applicant: HEWLETT-PACKARD DEVELOPMENT COMPANY, L.P., Houston, TX (US)

(72) Inventors: Xavier Quintero Ruiz, Sant Cugat del Valles (ES); David Gaston Llado, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/502,302

(22) PCT Filed: Aug. 25, 2014

(86) PCT No.: PCT/EP2014/067978
§ 371 (c)(1),
(2) Date: Feb. 7, 2017

(87) PCT Pub. No.: WO2016/029925
PCT Pub. Date: Mar. 3, 2016

(65) Prior Publication Data

US 2017/0225499 A1 Aug. 10, 2017

(51) Int. Cl.
*B41J 29/393* (2006.01)

(52) U.S. Cl.
CPC ..... *B41J 29/393* (2013.01)

(58) Field of Classification Search
CPC ..... B41J 29/393
See application file for complete search history.

(56) References Cited

U.S. PATENT DOCUMENTS

| | | | | |
|---|---|---|---|---|
| 5,796,414 | A * | 8/1998 | Sievert | B41J 2/2135 347/19 |
| 6,217,148 | B1 | 4/2001 | Adler | |
| 6,364,447 | B1 | 4/2002 | Boleda et al. | |
| 6,860,588 | B1 | 3/2005 | Holstun et al. | |
| 7,543,911 | B2 | 6/2009 | Mizes | |
| 8,472,069 | B2 | 6/2013 | Yamazaki | |
| 2002/0181986 | A1 * | 12/2002 | Castano | B41J 2/2135 400/74 |
| 2005/0179711 | A1 | 8/2005 | Yoshida | |
| 2009/0002410 | A1 | 1/2009 | Shirota | |

FOREIGN PATENT DOCUMENTS

| | | |
|---|---|---|
| EP | 1245399 | 10/2002 |
| JP | 2014028463 | 2/2014 |

OTHER PUBLICATIONS

Kipman, Y., Dot Placement Analysis Using a Line Scan Camera and Rigid Body Rotation, (Research Paper), May 10, 2004.<http://pdf.aminer.org/000/540/743/dot_placement_analysis_using_a_line_scan_camera_and_rigid.pdf>.

* cited by examiner

*Primary Examiner* — Bradley Thies
(74) *Attorney, Agent, or Firm* — HP Inc. Patent Department

(57) ABSTRACT

According to one example, there is provided a method of determining an alignment characteristic of a printhead die installed in a printer. The method comprises controlling the printer to print a predetermined pattern using the printhead die and determining, through analysis of the distance between features of the printed predetermined pattern, alignment characteristics of the printhead die.

20 Claims, 5 Drawing Sheets

DETERMINING AN ALIGNMENT CHARACTERISTIC BASED ON DISTANCES OF FEATURES OF A PRINTED PATTERN

BACKGROUND

Scanning inkjet printers typically have a relatively small printhead compared to the width of media on which they are used to print on. Printheads are scanned across the width of the media, in one or multiple passes, to print a swath of an image. The media is then advanced a small distance to allow a subsequent swath to be printed. The time taken to generate printed output is therefore highly dependent on the time it takes the printheads to scan across the width of the media.

Page-wide array printers typically have a static wide array of inkjet nozzles configured to provide a print zone of a chosen width. Since the array of nozzles are not scanned across the width of the media, the media may be advanced in a continuous motion. This enables the printing speeds of page-wide array printers to be generally significantly higher than scanning inkjet printers.

BRIEF DESCRIPTION

Examples will now be described, by way of non-limiting example only, with reference to the accompanying drawings, in which.

Figure 8B:
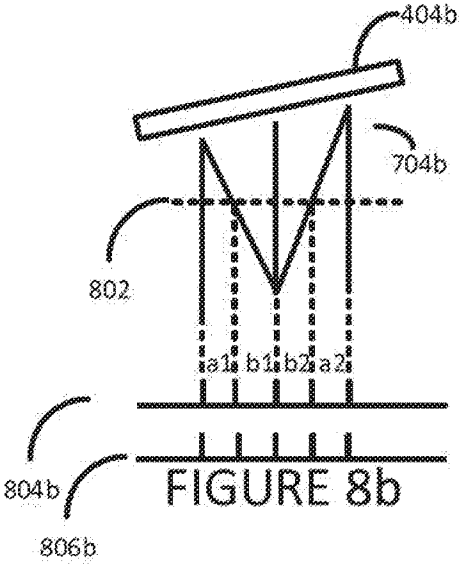
Figure 8A:
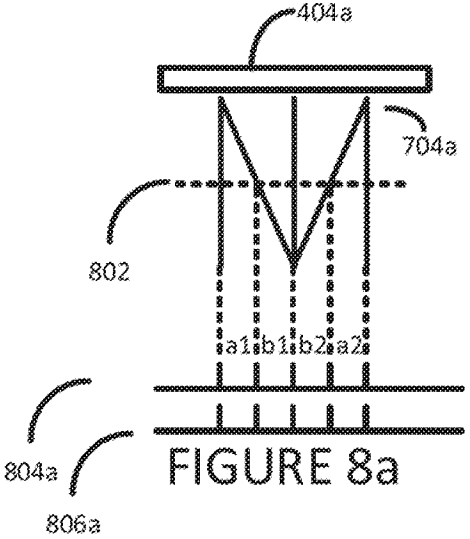
Figure 8C:
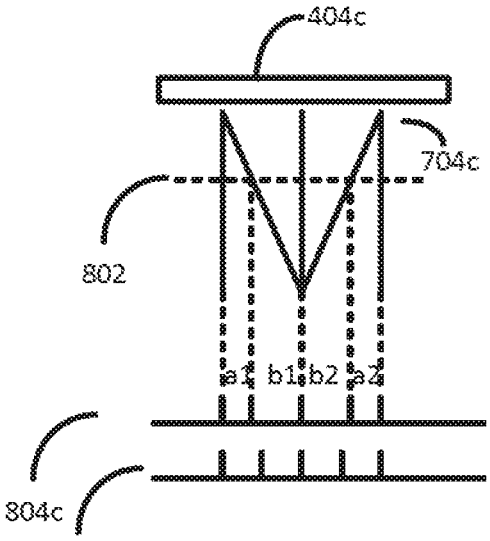
Figure 8D:
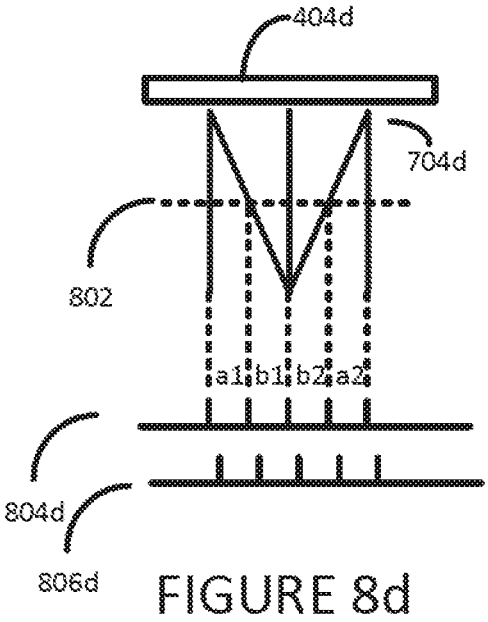
Figure 8E:
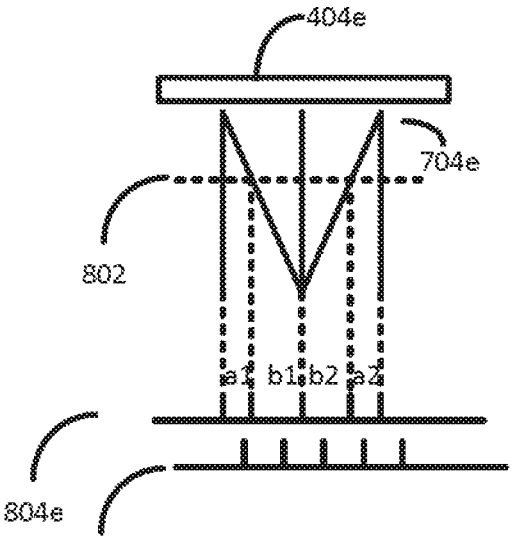
Figure 8F:
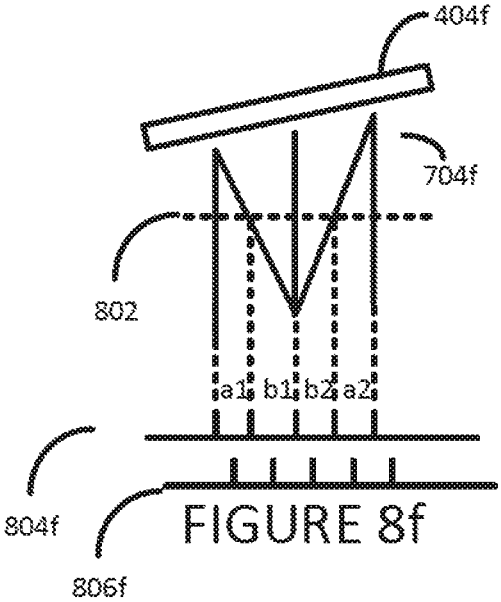
Figure 8G:
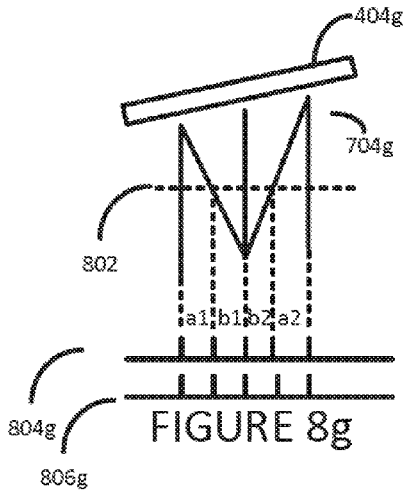
Figure 8H:
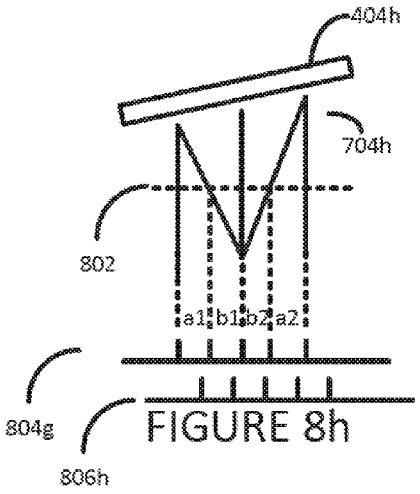
Figure 9:
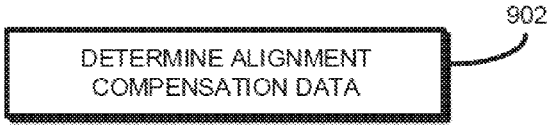
Figure 10:
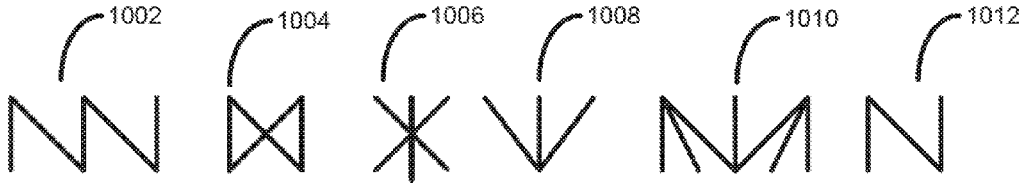

FIGS. 8*a* and 8*h* are illustrations of printed patterns according to one example;

FIG. 9 is flow diagram outlining an example method of operating a printing system according to one example; and FIG. 10 is an illustration showing some additional patterns according to various examples.

DETAILED DESCRIPTION

Some page-wide array printers have a single printhead that comprises multiple printhead dies. Each printhead die comprises a group of inkjet nozzles. Some page-wide array printers have multiple printheads that each comprise one or multiple dies. The printhead, or collection of printheads, define a print zone. Page-wide array office printers may, for example, have a print zone in the region of about 30 cm in length, whereas wide-format printers may have a print zone up to, or in excess of, 100 cm.

The printhead, or collection of printheads, in a page-wide printer is often referred to as a print bar.

In one example a page-wide array printer may have a print bar 1 m in length that may comprise multiple printhead dies, and may comprise more than 200000 inkjet nozzles.

To provide high quality prints, the different printhead dies in a print bar have to be accurately aligned with one another. Although printhead dies are generally aligned using accurate manufacturing processes, some misalignment of dies may be present in a printhead. Furthermore, where multiple printheads are used in a print bar, some misalignment may occur between dies of different printheads.

Although some mechanical misalignment is generally difficult to avoid the printer control systems generally allow for any such misalignment to be corrected for, for example by modifying the timing of nozzle firing signals.

However, before any misalignment compensation can be applied the extent of any misalignment has to be determined.

Figure 1:
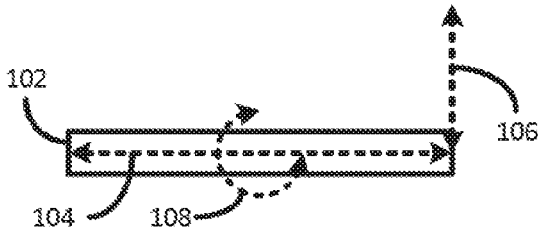
FIG. 1 is a simplified plan view of a print bar according to one example.

There exist three main types of die misalignment, as illustrated in FIG. 1 which shows a plan view of a print bar 102.

One type of die misalignment is print bar axis misalignment 104. Another type of die misalignment is cross-print bar axis misalignment 106, which is perpendicular to print bar axis misalignment 104. Another type of die misalignment is rotational misalignment 108, which is a rotational misalignment about a plane defined by the print bar axis 104 and the cross-print bar axis 106.

Examples described herein provide a printing system and a method of operating a printing system that enables the aforementioned types of die misalignment to be determined in a simple and efficient manner by printing and analyzing a predetermined test pattern.

Figure 2:
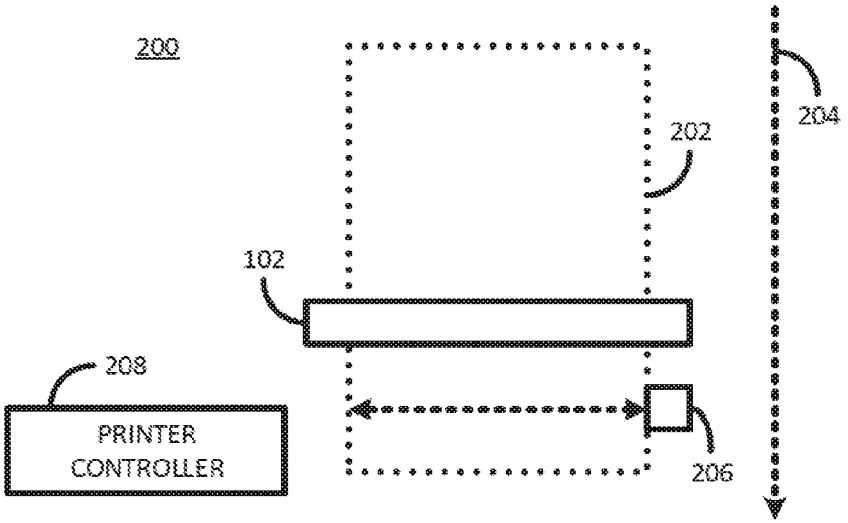
FIG. 2 is a simplified plan view of a printing system according to one example.

Referring now to FIG. 2 there is shown a simplified plan view of a printing system 200 according to one example.

The printing system 200 comprises a page-wide array print bar 102 comprising one or multiple printhead dies. A media 202, when present in the printing system 200, may have content printed thereon by advancing the media 202 in a media advance axis 204 under the print bar 102.

The printing system 200 further comprises an imaging module 206, such as an optical scanner, that can obtain data representing a portion of printed content printed on the media 202. In one example the obtained data may be a digital data signal representing an electrical signal. In another example the obtained data may be in the form of image data.

In one example the imaging module 206 may scan back and forth along the print bar axis, for example if the imaging module 206 is narrower than the width of the media 202.

In one example the imaging module 206 may comprise a light source to direct light onto the media 202 and may comprise a light sensor that generates an electrical signal based on the amount of light reflected from the media 202. For example, portions of a media on which no pattern is printed may result in an electrical voltage at a first level (such as 0 V) being obtained, and portions of a media on which a portion of a printed pattern is printed may result in an electrical voltage at a second level (such as 5 V) being obtained. In other examples other types of electrical signal, such as an electrical current, may be obtained. In other examples other levels of electrical signal may be obtained. In some examples the light source may be changed, or selected, based on the color, or colors, of ink used to print the pattern 702. In one example the electrical signal may be converted into a digital data signal.

In another example the imaging module 206 may span the width of the media 202 and be static.

Figure 3:
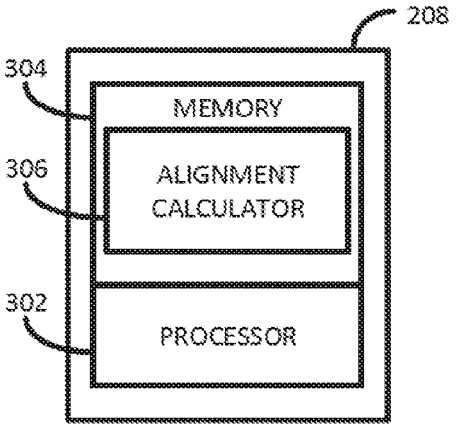
FIG. 3 is block, diagram of a printer controller according to one example.

The operation of the printing system 200 is generally controlled by a printer controller 208, which is shown in greater detail in FIG. 3. The printer controller 208 comprises a processor 302, such as a microprocessor or microcontroller, coupled to a non-transitory computer readable memory 304, for example through a communications bus (not shown). The memory 304 stores printing system alignment calculator instructions 306 which are machine readable instructions that, when executed by the processor 302, cause the printer controller 208 to control the printing system 200 as described herein in various examples.

Figure 4:
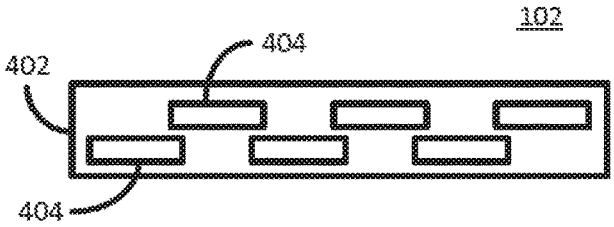
FIG. 4 is a simplified plan view of a printhead according to one example.

In one example, as illustrated in FIG. 4, the print bar 102 comprises a single printhead 402 that comprises an array of printhead dies 404. In one example the dies 404 may be arranged in an overlapping configuration to help reduce image quality problems compared to printhead dies which are linearly aligned.

Figure 5:
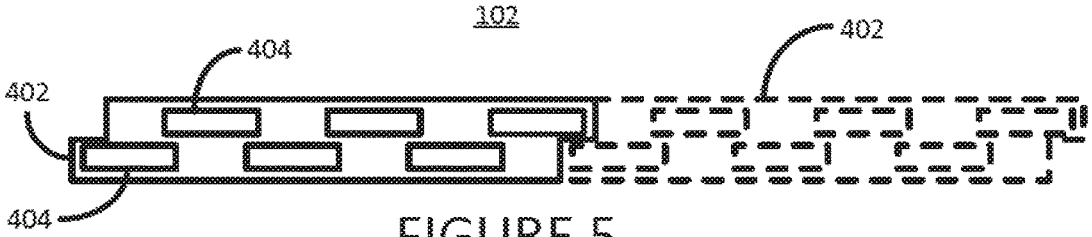
FIG. 5 is a simplified plan view of a print bar according to one example.

In another example, as illustrated in FIG. 5, the print bar 102 comprises a plurality of printheads 402, with each printhead comprising one or multiple printhead dies. The configuration of the printheads 402 enable multiple printheads 402 to be assembled linearly, to provide a print bar 102 of a desired length.

Figure 6:
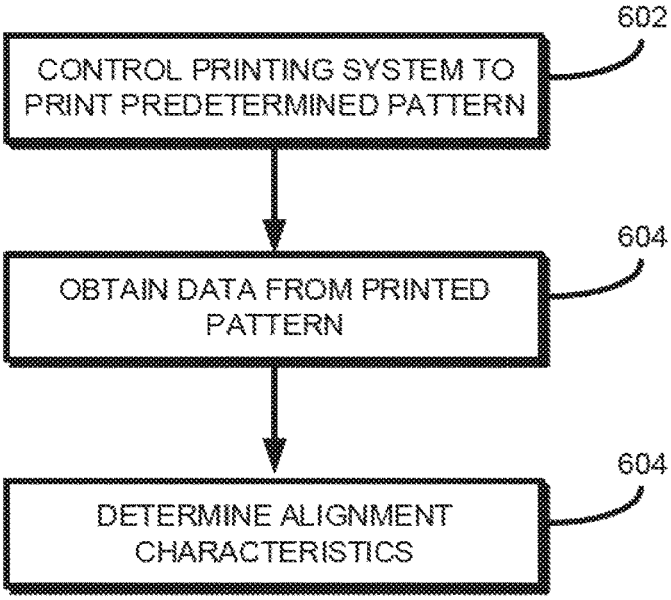
FIG. 6 is flow diagram outlining an example method of operating a printing system according to one example.

Operation of the printing system 100, according to an example, will now be described with reference to the flow diagram of FIG. 6.

At block 602, the printer controller 208 controls the printing system 100 to print a predetermined pattern. In one example the printer controller 208 controls the printing system 100 to print the predetermined pattern in black ink. In other examples, however the printer controller 208 may control the printing system 100 to print the predetermined pattern using any one, or any combination, of the process inks available in the printing system 100.

Figure 7:
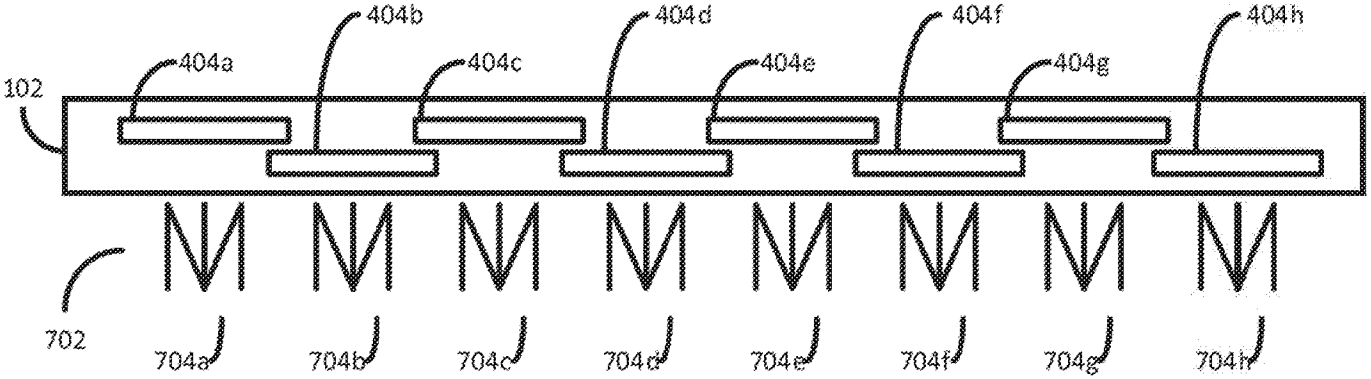
FIG. 7 is an illustration of a pattern printed by dies of a print bar according to one example.

An example of the predetermined pattern is shown as pattern 702 in FIG. 7. The pattern 702 comprises a set of one or multiple sub-patterns 704. In the example shown each sub-pattern 704*a* to 704*h* is arranged to be printed in its entirety by a single respective printhead die 404*a* to 404*h*. For example, sub-pattern 704*a* is printed in its entirety by printhead die 404*a*, sub-pattern 704*b* is printed in its entirety by printhead die 404*b*, and so on. In other examples, as described further below, the printer controller 208 controls the printing system 100 to print a different predetermined pattern.

In one example each sub-pattern 704 may be in the region of about 600 nozzles wide, and may be in the region of about 2 to 3 cm high. The width of each line may be in the region of about 40 nozzles wide. In other examples, however, each sub-pattern may be larger or smaller, or have thicker or thinner lines. As described below, different patterns 702 and sub-patterns 704 may be used in different examples. In one example, different patterns may be printed by different dies.

At block 604 the printer controller 208 controls the imaging module 206 to obtain data from at least a portion of the printed pattern 702. In one example, the printer controller 208 obtains data by controlling the imaging module 206 to obtain electrical signals based on the amount of light from a light source reflected from the media on which the pattern 702 has been printed.

In one example the printer controller 208 controls the imaging module 206 to scan at least a portion of the printed pattern 702.

In the examples described herein, the printer controller 208 controls the imaging module 206 to scan at least a portion of the printed pattern 702 that is mid-way between the top and the bottom of the first printed pattern 704*a*, as indicated by the dotted line 802 in FIG. 8*a*. For example, since the printer controller knows or may determine, the position of the pattern 704*a* on the media it may position the appropriate portion of the media under the imaging module 206 such that an appropriate portion of the pattern 704*a* is scanned.

In other examples the printer control 208 may control the imaging module 206 to scan at least a portion of the printed pattern 702 along a line that is not mid-way between the top and bottom of the first printed pattern 704*a*.

An example of the data signals obtained by the imaging module 206 are illustrated in FIGS. 8*a* to 8*h* as data signals 804*a* to 804*h*.

At block 604, the printer controller 208 analyzes the obtained data signals to determine alignment characteristics of different ones of the printhead dies 404*a* to 404*g* in the print bar 102. In one example the printer control 208 compares the obtained data signal with a reference, or expected, data signal. In one example the reference data signal may represent a reference electrical signal. The reference data signal may be generated, for example, based on the position along which the printed pattern 702 is scanned.

Referring to FIGS. 8*a* to 8*h*, it can be seen that the data signals 804*a* to 804*h* respectively correspond to portions of the printed patterns 704*a* 704*h*, along the line 802. Alignment characteristics of a printhead die may thus be determined based on the determined distances between different portions of the scanned printed pattern. For example, the distance between each of the peaks of the data signals 804*a* to 804*h* is denoted by the lengths a1, b1, b2, and a2. As can be seen in FIG. 8*a*, the sub-pattern 704*a* is designed such that, when the imaging member is scanned along the line 802 which is mid-way between the top and the bottom of the sub-pattern, the lengths of a1, b1, b2, and a2 are equal. If, however, the imaging member is scanned along a line which is not mid-way between the top and the bottom of the pattern the lengths of a1, b1, b2, and a2 will change accordingly.

As can be seen in FIG. 8*a*, the obtained signal 804*a* is perfectly aligned with the reference or expected data 806*a*. This indicates that the die 404*a* that printed the sub-pattern 704*a* is aligned in the print bar axis, in the cross-axis, and is not rotationally misaligned.

If however, the die which printed the sub-pattern 704 were misaligned, the data signal obtained from each scanned sub-pattern will differ from the reference data signal 806*a* as shown in FIGS. 8*b* to 8*h*.

As can be seen in FIG. 8*b*, the die 404*b* that printed the sub-pattern 704*b* is rotationally misaligned compared to the die 404*a*. This results in the lengths a1, b1, b2, and a2 not being equal. A positive or negative angle of misalignment can be determined from the relationship between a1 & a2 and between b1 & b2. For example, if a1<a2 and b1>b2, this indicates that the die that printed the pattern has a rotational misalignment in a counterclockwise direction, as shown in FIG. 8*b*. Similarly, if a1>a2 and b1<b2, this would indicate that the die that printed the pattern has a rotational misalignment in a clockwise direction As illustrated in FIG. 8*c*, the die 404*c* that printed the sub-pattern 704*c* is misaligned in the cross print bar axis which results in the scan line 802 not being mid-way between the top and the bottom of the pattern 704*c*. This results in the lengths a1 and a2 being equal, and the lengths b1 and b2 being equal, but results in length a1 being different to length b1. The difference in the lengths a1 and b1 enables the printer controller 208 to determine the degree of cross print bar misalignment. For example, if the length a1 determined from the data signal 804*c* is longer than the length of a1 determined from the data signal 804*a*, this indicates that the die is offset in the media advance direction.

As illustrated in FIG. 8*d*, the die 404*d* that printed the sub-pattern 704*d* is misaligned in the print bar axis. Accordingly, the obtained data signal 804*d* has the same shape as the reference data signal 806*a*, but is offset therefrom. The amount of offset enables the printer controller 208 to determine the degree and direction of print bar misalignment.

As illustrated in FIG. 8*e*, the die 404*e* that printed the sub-pattern 704*e* is misaligned in both the print bar axis and in the cross print bar axis. Accordingly, the lengths a1, b1, b2, and a2 determined from the obtained data signal 804*e* enable the printer controller 208 to determine the degree of cross print bar misalignment, and the amount of offset of the data signal 804*e* compared to the reference data signal 806*e* enables the printer controller 208 to determine the degree and direction of print bar axis misalignment.

As illustrated in FIG. 8*f*, the die 404*f* that printed the sub-pattern 704*f* has both rotational misalignment and is misaligned in the print bar axis. Using the techniques described above, the printer controller 208 can determine the angle of rotational misalignment and the degree and direction of print bar axis misalignment.

As illustrated in FIG. 8*g*, the die 404*g* that printed the sub-pattern 704*g* has both rotational misalignment and is misaligned in the cross print bar axis. Using the techniques described above, the printer controller 208 can determine the angle of rotational misalignment and the degree and direction of cross print bar axis misalignment.

As illustrated in FIG. 8*h*, the die 404*h* that printed the sub-pattern 704*h* has rotational misalignment and is misaligned in both the print bar axis and in the cross print bar axis. Using the techniques described above, the printer controller 208 can determine the angle of rotational misalignment, the degree and direction of print bar axis misalignment and the degree and direction of cross print bar axis misalignment.

Once the printer controller 208 has determined the presence and degree and direction of any die misalignment, it may, as illustrated in FIG. 9, further determine alignment compensation data to correct, or mitigate, for any such misalignment. For example, correction may include adjusting nozzle firing timing, logical shifting of nozzles used in each die, or any other appropriate technique.

In one example, the printer controller 208 may determine an average die misalignment per printhead, for example, based on determined die misalignments for one or multiple ones of the dies in each printhead.

The examples above have been illustrated using a pattern 702 comprising sub-patterns 704, with each sub-pattern comprising three spaced vertical lines, with one oblique line joining one end of the first and second vertical lines, and a second oblique line joining one end of the second and third lines, in a generally 'M' shaped arrangement. The combination of vertical lines and oblique lines enables the printer controller 208 to determine a degree of misalignment of the aforementioned types in a quick and efficient manner. In the examples described above, only a single pattern 702 has to be printed and a single scan of a portion of the printed pattern is sufficient to enable alignment characteristics of a printhead die to be determined. The vertical lines provide accurate reference points to enable print bar misalignment to be determined, and the oblique lines provide accurate reference points to enable rotational misalignment and cross print bar misalignment to be determined. Furthermore, the pattern 702 may be printed at a relatively small height, for example less than 5 cm, which reduces the amount of media wasted during a die alignment procedure.

FIG. 10 shows a number of non-limiting examples 1002, 1004, 1006, 1008, 1010 and 1012, of other sub-patterns that have features that are suitable for enabling various types of die misalignment, as described herein, to be determined. It can be seen that each of these patterns comprises at least one vertical line and at least one oblique line.

It will be appreciated that examples described herein can be realized in the form of hardware, or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are example of machine-readable storage that are suitable for storing a program or programs that, when executed, implement examples described herein. Accordingly, examples provide a program comprising code for implementing a system or method as claimed in any preceding claim and a machine readable storage storing such a program.

The invention claimed is:

1. A system comprising:

an imaging scanner; and a controller to:

control a print member comprising a printhead die comprising a plurality of nozzles, to print a test pattern using at least some of the nozzles of the printhead die, the print member and a media onto which the test pattern is printed being relatively movable along a first axis;

control the imaging scanner to obtain data representing at least a portion of the printed test pattern, the obtained data representing signals corresponding to detected features of the test pattern; and analyze the obtained data to determine an alignment characteristic of the printhead die, the analyzing comprising determining a first distance along a second axis between a first pair of the features, and a second distance along the second axis between a second pair of the features, and detecting a misalignment of the printhead die responsive to the first distance being different from the second distance, the second axis being perpendicular to the first axis.

2. The system of claim 1, wherein the controller is to analyze the obtained data to determine the alignment characteristic of the printhead die in one or more of: the first axis; and a degree of rotation relative to a plane defined by the first and second axes.

3. The system of claim 2, wherein the controller is to further determine an alignment characteristic of the printhead in the second axis by comparing the obtained data to reference data, and indicating misalignment of the printhead die in the second axis in response to detecting an offset between the obtained data and the reference data.

4. The system of claim 1, wherein:

the print member comprises a plurality of printhead dies;

the test pattern comprises a set of sub-patterns; and the controller is to control each printhead die of the plurality of printhead dies to print a different sub-pattern of the set of sub-patterns.

5. The system of claim 1, wherein the controller is control the imaging scanner to obtain data representing at least the portion of the printed test pattern in a single scan.

6. The system of claim 1, wherein the test pattern comprises at least three vertical lines and oblique lines connecting the vertical lines.

7. The system of claim 1, wherein the controller is to:

determine alignment compensation data based on the determined alignment characteristic, and cause application of the alignment compensation data to correct for the misalignment of the printhead die.

8. The system of claim 7, wherein the application of the alignment compensation data adjusts activations of the nozzles of the printhead die.

9. The system of claim 1, wherein the analyzing further comprises:

determining a third distance along the second axis between a third pair of the features, and a fourth distance along the second axis between a fourth pair of the features;

comparing the first distance to the second distance and comparing the third distance to the fourth distance, wherein the detecting of the misalignment of the printhead die is responsive to the first distance being different from the second distance, and the third distance being different from the fourth distance.

10. The system of claim 9, wherein the detecting is of a rotational misalignment of the printhead die relative to the media.

11. The system of claim 10, wherein the rotational misalignment is indicated responsive to either:

the first distance being less than the second distance, and the third distance being greater than the fourth distance, or the first distance being greater than the second distance, and the third distance being less than the fourth distance.

12. A method executed by a printer controller of determining alignment of a printhead die installed in a printer, comprising:

controlling the printer to print a predetermined pattern using the printhead die, the printhead die on a print member relatively movable along a first axis with respect to a media on which the predetermined pattern is printed; and determining, through analysis of distances between features of the printed predetermined pattern, an alignment characteristic of the printhead die, the determining comprising determining a first distance along a second axis between a first pair of the features, and a second distance along the second axis between a second pair of the features, and detecting a misalignment of the printhead die responsive to the first distance being different from the second distance, the second axis being perpendicular to the first axis.

13. The method of claim 12, further comprising obtaining, using an optical scanner, data representing a portion of the printed predetermined pattern.

14. The method of claim 12, wherein printing the predetermined pattern comprises printing a pattern having at least three vertical lines and oblique lines connecting the vertical lines.

15. The method of claim 12, further comprising:

determining alignment compensation data based on the determined alignment characteristics; and applying the determined alignment compensation data to the printer to correct the misalignment of the printhead die.

16. The method of claim 12, wherein the determining of the alignment characteristic further comprises:

determining a third distance along the second axis between a third pair of the features, and a fourth distance along the second axis between a fourth pair of the features;

comparing the first distance to the second distance and comparing the third distance to the fourth distance, wherein the detecting of the misalignment of the printhead die is responsive to the first distance being different from the second distance, and the third distance being different from the fourth distance.

17. The method of claim 16, wherein the features comprise first, second, third, fourth, and fifth features, and the detecting is of a rotational misalignment of the printhead die relative to the media, and wherein the first distance is between the first feature and the second feature, the second distance is between the fourth feature and the fifth feature, the third distance is between the second feature and the third feature, and the fourth distance is between the third feature and the fourth feature.

18. A controller comprising:

a processor; and a non-transitory storage medium storing instructions executable on the processor to:

cause printing, on a media, a predetermined pattern using a printhead die on a print member, the print member and the media being relatively movable along a first axis;

obtain data representing features of the printed predetermined pattern;

determine, from the obtained data, an alignment characteristic of the printhead die, the determining comprising:

determining a first distance along a second axis between a first pair of the features, determining a second distance along the second axis between a second pair of the features, determining a third distance along the second axis between a third pair of the features, and determining a fourth distance along the second axis between a fourth pair of the features, the second axis being perpendicular to the first axis;

detecting a rotational misalignment of the printhead die responsive to the first distance being different from the fourth distance, and the second distance being different from the third distance; and compensate for the rotational misalignment of the printhead die based on the determined alignment characteristic.

19. The controller of claim 18, wherein the features comprise first, second, third, fourth, and fifth features, the obtained data being from an optical scanner extending along the second axis that intersects the first, second, third, fourth, and fifth features, and wherein the first distance is between a first intersecting point of the second axis and the first feature and a second intersecting point of the second axis and the second feature, the second distance is between the second intersecting point and a third intersecting point of the second axis and the third feature, the third distance is between the third intersecting point and a fourth intersecting point of the second axis and the third feature, and the fourth distance is between the fourth intersecting point and a fifth intersecting point of the second axis and the fifth feature.

20. The controller of claim 18, wherein the instructions are executable on the processor to further:

compare the obtained data to reference data; and indicate misalignment of the printhead die in the second axis in response to detecting an offset between the obtained data and the reference data.

* * * * *